US006892975B2

(12) United States Patent
Yu Chen

(10) Patent No.: US 6,892,975 B2
(45) Date of Patent: May 17, 2005

(54) FILM HAND WRAPPER

(76) Inventor: Hsiu-Man Yu Chen, No. 27, Sec 1, Ta Fu Road, Tan Tzu Hsiang, Taichung (TW), 427

( * ) Notice: Subject to any disclaimer, the term of this patent is extended or adjusted under 35 U.S.C. 154(b) by 288 days.

(21) Appl. No.: 10/263,721

(22) Filed: Oct. 4, 2002

(65) Prior Publication Data

US 2004/0065577 A1 Apr. 8, 2004

(51) Int. Cl.[7] ..... B65H 75/02
(52) U.S. Cl. ..... 242/422.4; 242/588.2
(58) Field of Search ..... 206/497; 242/588, 242/588.2, 596.7, 422.4, 422.9

(56) References Cited

U.S. PATENT DOCUMENTS 5,961,063 A * 10/1999 Parry ..... 242/422.4
6,027,069 A * 2/2000 Huang ..... 242/588.2
6,227,480 B1 * 5/2001 Huang ..... 242/588.2
6,651,918 B2 * 11/2003 Huang ..... 242/423.1

* cited by examiner

*Primary Examiner*—Jacob K. Ackun, Jr.
(74) *Attorney, Agent, or Firm*—Troxell Law Office, PLLC

(57) ABSTRACT

A film hand wrapper includes two cylindrical grips, two friction elements and two sleeves. The cylindrical grip has a large-diameter portion and a small-diameter portion, and a push member provided in the large-diameter portion and combined with the friction element. When the push member is pressed by a finger of a user, the friction element produces a stopping force against a friction ring of the sleeve so that a film winding cylinder positioned between two of the film hand wrappers combined with two ends of the film cylinder may be stopped, with the film on the film winding cylinder impossible to unwind so as to permit the user pull tight the film for wrapping an object.

6 Claims, 4 Drawing Sheets

FILM HAND WRAPPER

BACKGROUND OF THE INVENTION

This invention relates to a film hand wrapper, particularly to one for packaging, having a friction element respectively provided with two opposite ends of a film winding cylinder for wrapping a large volume of merchandise with film.

A conventional film hand wrapper is very often employed in various industries, for example, when a lift truck is used for moving and placing a large volume of goods on a storing board, the goods of different sizes and shapes are liable to fall off the storing board. Then a film made of plastic is usually used to wrap around goods on a storing board for convenience of transporting and also preventing dust from accumulating on the goods. So a film hand wrapper shown in FIG. 1 has to be used for wrapping, including a film-winding cylinder 2, two cylindrical grips 3 fixed on two ends of the film-winding cylinder 2. Then a user holds the film hand wrappers 1 with two hands 4 and pulls the film hand wrapper 1 to a rear side to force the film on the film-winding cylinder to unwind for wrapping.

However, in using the conventional film hand wrapper shown in FIG. 1, the film unwinding out of the film winding cylinder 2 has to be pulled tightly for wrapping around all of the goods on a storing board, but the film on the film winding cylinder 2 will still unwind even in tightening the film. So the film winding cylinder has to be manually held tight, not letting the film unwind, then another person has to hold the film winding cylinder immovable to help the user, as the user has two hands 4 already holding the two ends of the film cylinder 2. Therefore, only one person can hardly use the conventional film hand wrapper, quite inconvenient.

SUMMARY OF THE INVENTION

This invention has been devised to offer a film hand wrapper provided with a pushing member for stopping two cylindrical grips fixed with two sides of a film winging cylinder from which film unwinds so that the film on the film winding cylinder may not unwind so as to pull tight the film in wrapping goods in due time.

BRIEF DESCRIPTION OF DRAWINGS

This invention will be better understood by referring to the accompanying drawings, wherein.

DETAILED DESCRIPTION OF THE PREFERRED EMBODIMENT

A preferred embodiment of a film hand wrapper in the present invention, as shown in FIGS. 2 to 5, includes two cylindrical grips 10, two friction elements 20, two sleeves 30 as main components combined together.

Figure 1:
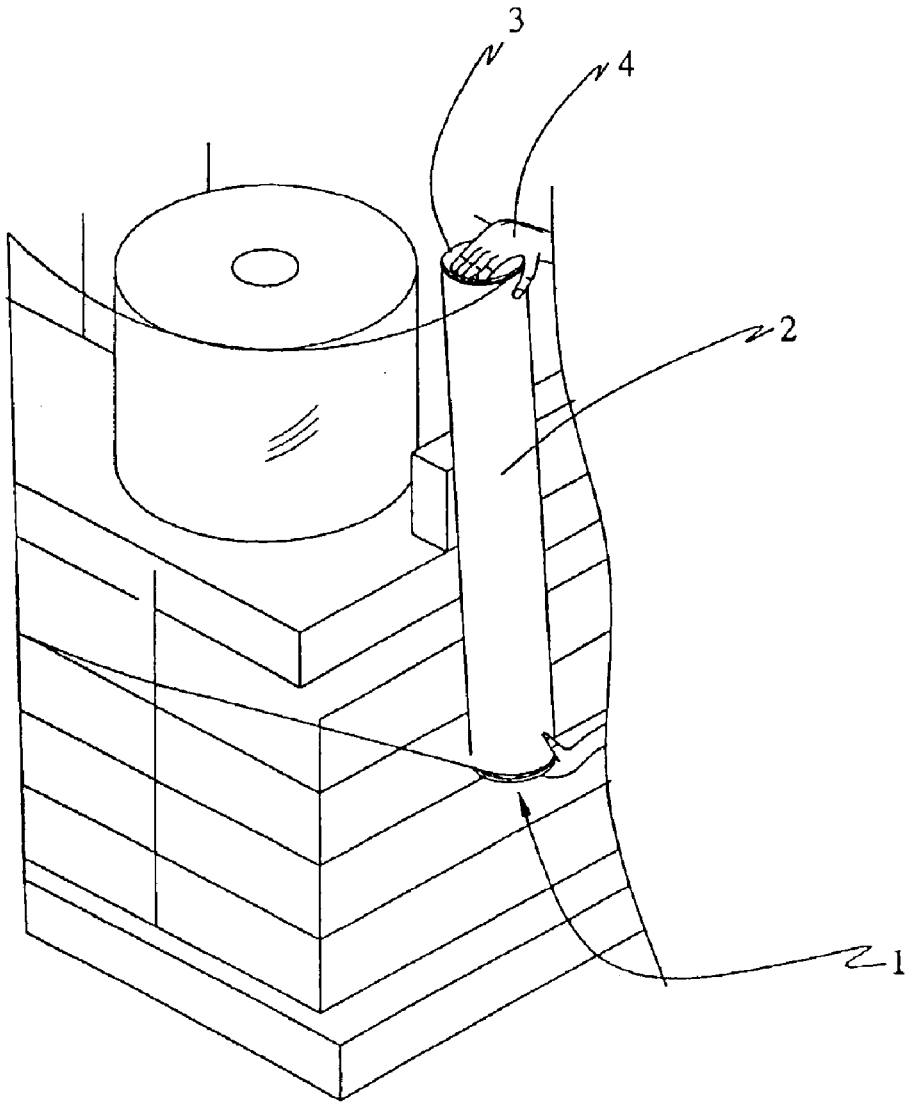
FIG. 1 PRIOR ART
FIG. 1 is a conventional film hand wrapper being in use.
Figure 2:
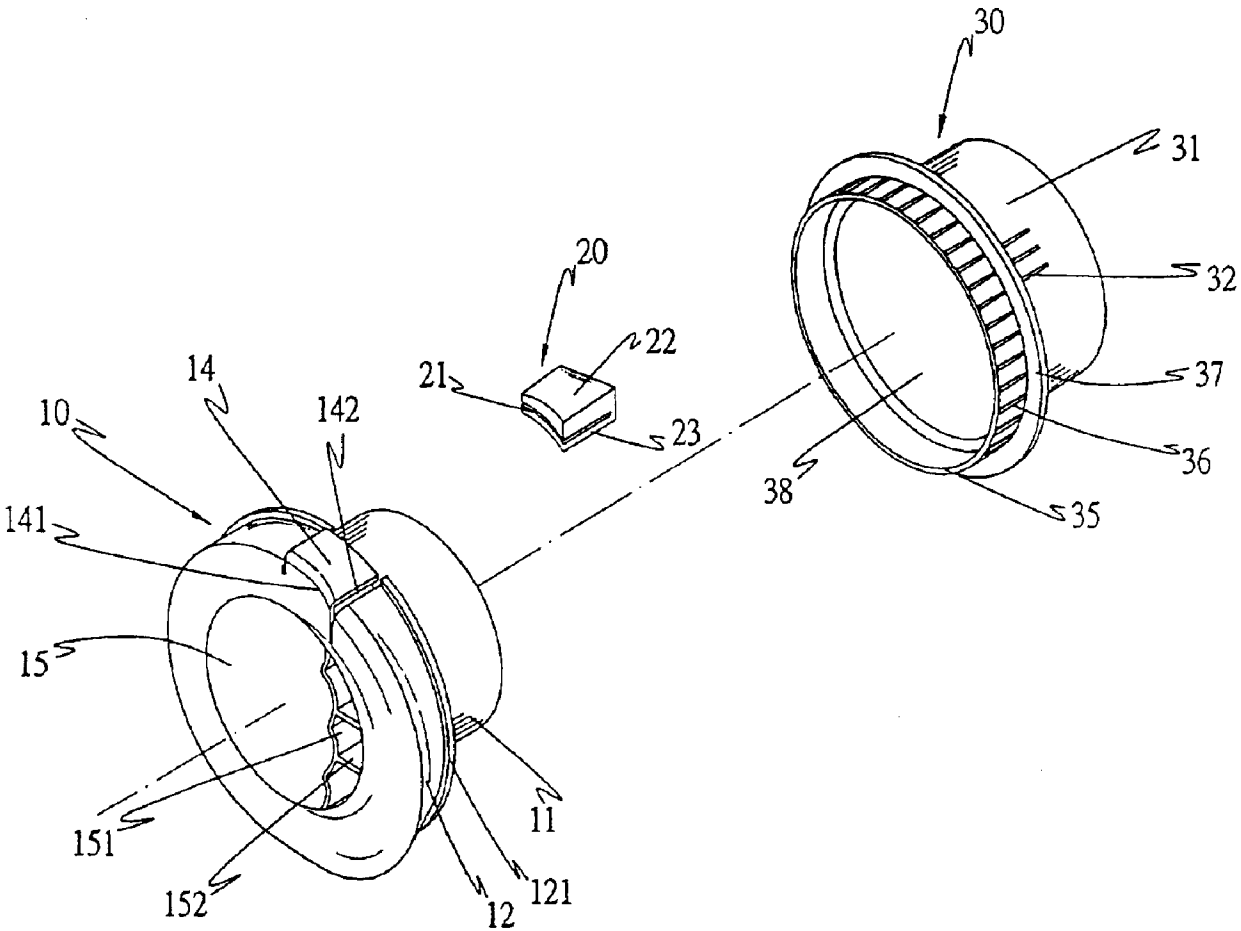
FIG. 2 is an exploded perspective view of a film hand wrapper in the present invention.
Figure 3:
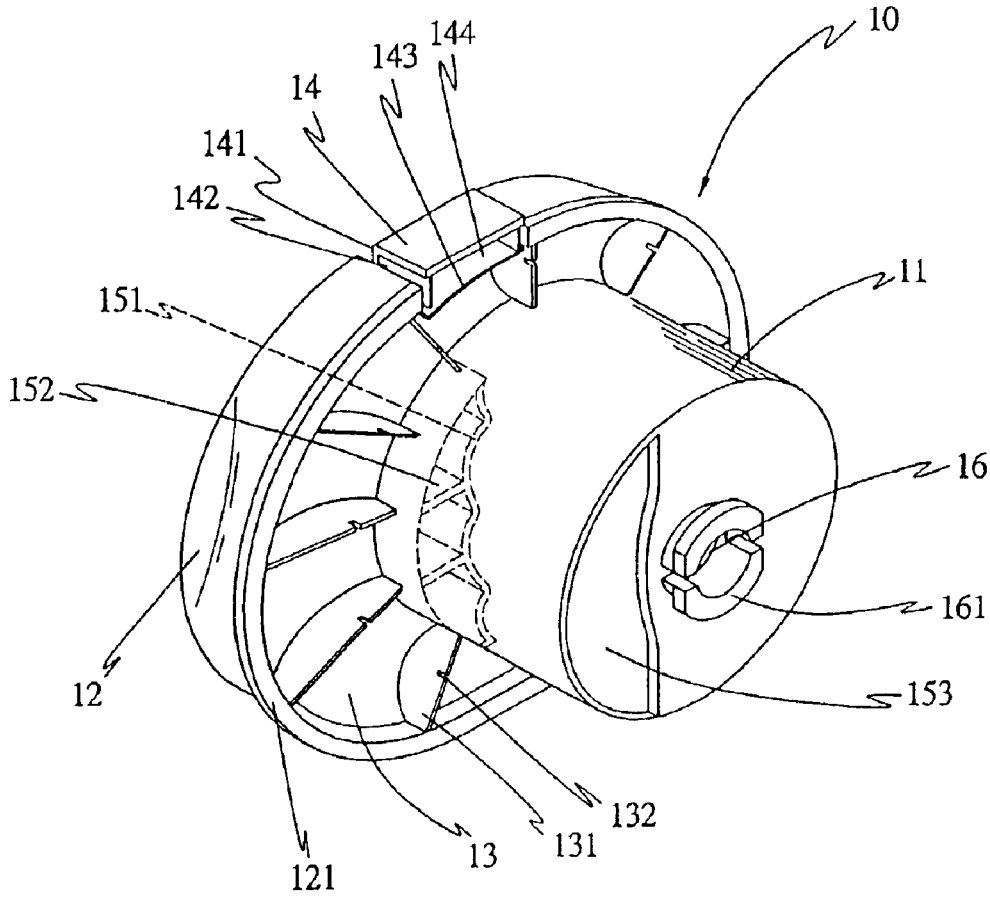
FIG. 3 is a perspective view of a cylindrical grip in the present invention.

As shown in FIGS. 2 and 3, the cylindrical grip 10 is shaped cylindrical, having a small-diameter portion 11 formed in an inner side, a large-diameter annular portion 12 formed in an outer side. The large-diameter portion 12 has an annular lip 121 on the inner side, and an annular recess 13 formed between an interior of the large-diameter portion 12 and the inner end of the small-diameter portion 11. A plurality of pressure-enduring plates 131 are provided spaced apart equidistantly in the annular recess 13, and each pressure-enduring plate 131 has an engage slot 132 in the center of an upper side for the sleeve 30 to fit therein to keep stably the sleeve 30. Then the lip 121 and the pressure-enduring plates 131 may also reinforce the large-diameter portion 12 to receive and endure pressure. The large-diameter portion 12 has a flexible push member 14 of a rectangular shape on an upper side, and a connect plate 141 provided at an outer side and connected with the large-diameter portion 12. A slot 142 is formed at two sides of the push member 14 to separate the push member 14 from the large-diameter portion 12. The connect plate 141 protrudes upward a little so as to be manually pressed. The push member 14 has a curved insert plate 143 formed in the bottom and an insert groove 144 formed between the curved insert plate 143 and the connect plate 141. The large-diameter portion 12 has a center hole 15 in an outer section, and the center hole 15 has a corrugated engage plate 151 at a right side, and a plurality of rib plates 152 provided between the corrugated engage plate 151 and the wall defining the center hole 15. The rib plates 152 support and endure pressure received by the cylindrical grip 10. Further, an engage hollow 153 is formed between the corrugated engage plate 151 and an outer side of the center hole 15 to easily receive a finger when a user holds the cylindrical grip 10. The small-diameter portion 11 has a center hole 16 communicating with the center hole 15. Then two opposite curved projections 161 are formed around the center hole 16 on an outer side surface of the small-diameter portion 11 so as to connect with the sleeve 30.

Figure 4:
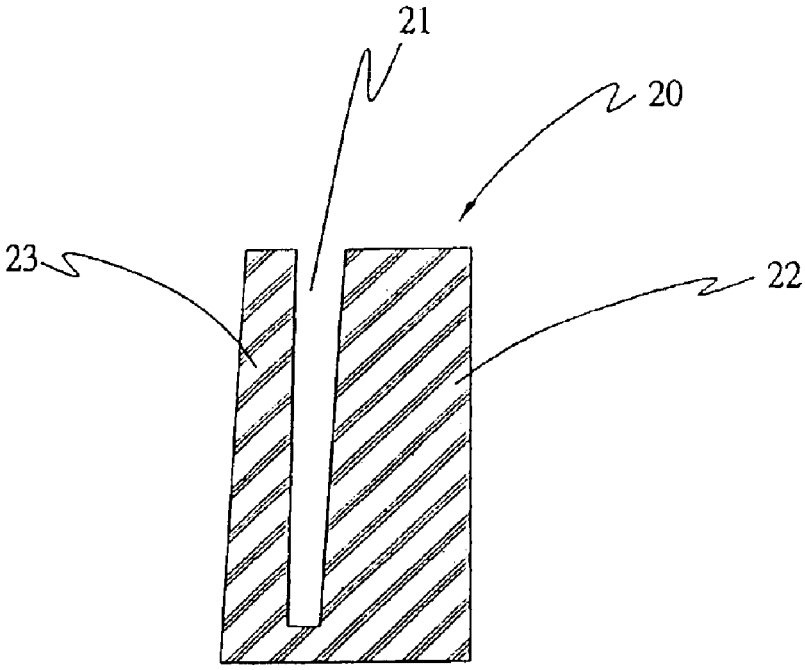
FIG. 4 is a cross-sectional view of a friction element in the present invention; and, FIG. 5 is a partial cross-sectional view of a sleeve in the present invention.

As shown in FIGS. 2, 3 and 4, the friction element 20 is made of rubber, shaped rectangular and having a U-shaped cross-section and a curved slit 21 formed in the center, and an insert plate 22 formed on the slit 21. The curved slit 21 fits with the curved insert plate 143, and the insert plate 22 is curved and has a thicker front side than a rear side, inserting firmly in the insert groove 144 of the push member 14. A stop plate 23 is formed under the slit 21, blocking the sleeve 30 in a stable position.

Figure 5:
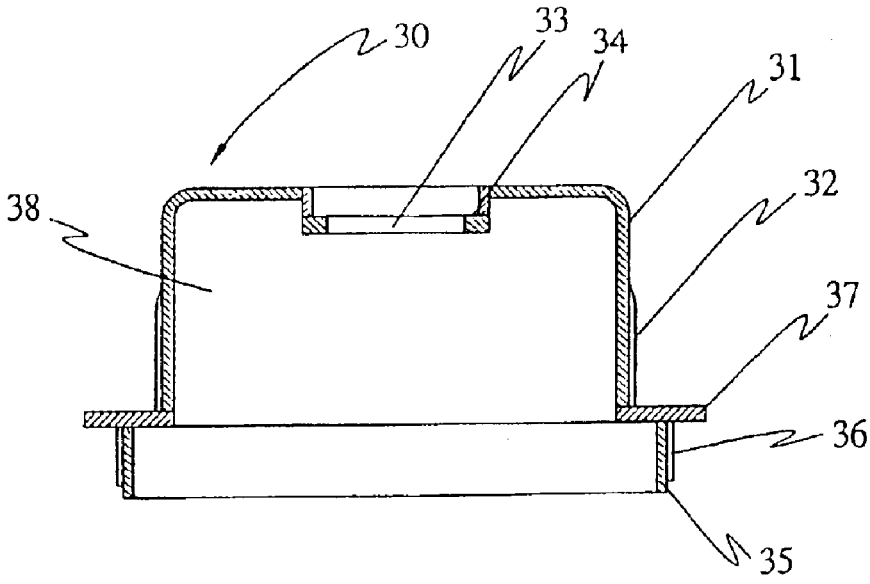

Next, as shown in FIGS. 2 and 5, the sleeve 30 is shaped cylindrical, having a rear fitting portion 31, and a shaft hole 33 in the center of an inner side, a plurality of ribs 32 formed on an outer surface for rotation relative to an film winding cylinder 2, and an engage annular wall 34 formed to define the shaft hole 33. The engage annular wall 34 engages with the two curved hooks 161 of the cylindrical grip 10. Further, the sleeve 30 has a friction ring 35 formed at an outer side, a plurality of small lengthwise teeth 36 formed spaced apart on an outer surface of the friction ring 35 for the block plate 23 of the friction element 20 to fit with one of them for mutual blocking. The friction ring 35 has its outer end fits in all of the engage cuts 132 of the cylindrical grip 10, in order to prevent the sleeve 30 from swaying during unwinding of a film. Further, the sleeve 30 has an annular stop ring 37 formed to protrude outward in an intermediate portion to prevent a hand from contacting the cylindrical grip 2, and in addition, a center hole 38 is formed in the friction ring 35 and the engage annular portion 31 for receiving the cylindrical body 11 of the cylindrical grip 10.

Next, the functions of the components of the film hand wrapper are to be described. The push member 14 has the insert groove 144 for the friction element 20 to fit therein, with the insert plate 143 fitting with the slit 21 of the friction element 20 and with the insert plate 22 inserting in the insert groove 144 to complete assembling the friction element 20 with the cylindrical grip 10. Then the small-diameter cylindrical body 11 of the cylindrical grip 10 is inserted in the sleeve 30, with the hooks 161 hooking with the block ring 37 so as to permit the cylindrical grip 10 rotate relative to the sleeve 30.

As the friction element 20 has the insert plate 22 in the upper side, and the stop plate 23 in a lower side, it needs only rotate the sleeve 30 for wrapping action in case of a large volume of goods, with the stop plate 23 separated from the friction ring 35. When a user exerts force with the two thumbs of both hands, pressing the flexible push member 13 and forcing the friction element 20 also move down to contact the friction ring 35. Then the stop plate 23 is also stopped by one of the small teeth 36 of the friction ring 35, and the sleeve 30 is temporarily stopped immovable, thus the user can stops the film-winding cylinder 2 and at the same time tightens the film unwinding from the film-winding cylinder 2 for wrapping action.

The friction element 20 is made of rubber, but it can also be made of flexible material, such as braking leather, PU, sand paper, etc. as long as it has pressing stopping function. In addition, the push member 14 is also possible to be replaced by another structure, such as a press button with resilience, or a switch key with flexibility so that a user may choose from them.

While the preferred embodiment of the invention has been described above, it will be recognized and understood that various modifications may be made therein and the appended claims are intended to cover all modifications that may fall within the spirit and scope of the invention.

I claim:

1. A film hand wrapper for a film winding cylinder comprising:

a) two cylindrical grips, each of the two cylindrical grips being connected to one of two opposing ends of the film winding cylinder and having:

i) a large-diameter cylindrical portion having a flexible push member movable between pressed and released positions;

ii) a small-diameter cylindrical portion having a small diameter that is smaller than a large diameter of the large-diameter cylindrical portion; and iii) a friction element being inserted onto the flexible push member; and b) two sleeves, each of the two sleeves having:

i) a center hole, the small-diameter cylindrical portion being rotatably inserted into the center hole; and ii) a friction ring formed on an outer periphery of a first end, wherein, when the flexible push member is in the pressed position, the friction element engages the friction ring thereby locking the film winding cylinder, and when the flexible push member is in the released position, the friction element disengages from the friction ring thereby allowing the film winding cylinder to rotate.

2. The film hand wrapper according to claim 1, wherein each flexible push member has a connect plate located on an end connecting the flexible push member to the large-diameter cylindrical portion and two sides, each of the two sides is spaced apart from the large-diameter cylindrical portion by a slot.

3. The film hand wrapper according to claim 1, wherein each flexible push member has a curved insert plate located on an interior surface thereof, and an insert groove located in an intermediate portion thereof; and each friction element has an insert plate and a curved stop plate separated from the insert plate by a curved slit, each curved insert plate is inserted into one curved slit.

4. The film hand wrapper according to claim 3, wherein the friction ring has a plurality of spaced apart teeth located on an outer periphery thereof, when the flexible push member is in the pressed position, the curved stop plate engages at least one of the plurality of spaced apart teeth, and when the flexible push member is in the released position, the curved stop plate disengages from the at least one of the plurality of spaced apart teeth.

5. The film hand wrapper according to claim 1, wherein each friction element is made of a material selected from the group consisting of rubber, sand paper, and PU plastic.

6. The film hand wrapper according to claim 1, wherein each of the two cylindrical grips has a center hole, an engage plate located on an interior periphery of the center hole, and an engage hollow communicating with the center hole.

* * * * *